US010096912B2

(12) United States Patent
Yamamoto et al.

(10) Patent No.: US 10,096,912 B2
(45) Date of Patent: Oct. 9, 2018

(54) CONNECTION METHOD FOR TERMINAL FITTING AND CONNECTION STRUCTURE OF TERMINAL FITTING

(71) Applicant: YAZAKI CORPORATION, Tokyo (JP)

(72) Inventors: Takatatsu Yamamoto, Shizuoka (JP); Keiichi Mita, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 15/363,555

(22) Filed: Nov. 29, 2016

(65) Prior Publication Data

US 2017/0155200 A1 Jun. 1, 2017

(30) Foreign Application Priority Data

Nov. 30, 2015 (JP) ..... 2015-233575

(51) Int. Cl.
*H01R 11/11* (2006.01)
*H01R 4/04* (2006.01)
(Continued)

(52) U.S. Cl.
CPC ..... *H01R 4/04* (2013.01); *H01R 4/188* (2013.01); *H01R 4/20* (2013.01); *H01R 11/12* (2013.01);
(Continued)

(58) Field of Classification Search
CPC .... H01R 13/28; H01R 13/111; H01R 13/187; H01R 4/185; H01R 4/183; H01R 11/12
(Continued)

(56) References Cited

U.S. PATENT DOCUMENTS 3,767,841 A * 10/1973 Anderson ..... H01R 4/2495 174/84 C
4,813,893 A * 3/1989 Sindlinger ..... H01R 4/20 29/882
(Continued)

FOREIGN PATENT DOCUMENTS

CN 101053122 A 10/2007
CN 103733433 A 4/2014
(Continued)

OTHER PUBLICATIONS

Chinese Office Action for the related Chinese Patent Application No. 201611080994.8 dated Jul. 3, 2018.

*Primary Examiner* — Thanh Tam Le
(74) *Attorney, Agent, or Firm* — Kenealy Vaidya LLP

(57) ABSTRACT

A connection method for a terminal fitting, in which the terminal fitting includes a terminal body and a plurality of terminal connection portions extending from the terminal body, and a pair of fastening caulking pieces of each of connection terminals connected to end portions of electric wires are caulked and connected to a pair of fastened caulking pieces formed in a corresponding one of the terminal connection portions, the connection method includes folding open end portions of the fastened caulking pieces inward respectively to form folded portions and a space between the folded portions so that open end portions of the pair of fastening caulking portions enter the space, and crushing the pair of the fastening caulking pieces to caulk the pair of the fastened caulking pieces so that the open end portions of the pair of the fastening caulking pieces enter the space.

7 Claims, 7 Drawing Sheets

(51) Int. Cl.

| | |
|---|---|
| ***H01R 4/18*** | (2006.01) |
| ***H01R 11/28*** | (2006.01) |
| ***H01R 43/048*** | (2006.01) |
| ***H01R 43/26*** | (2006.01) |
| ***H01R 4/20*** | (2006.01) |
| ***H01R 11/12*** | (2006.01) |
| *H01R 11/09* | (2006.01) |

(52) U.S. Cl.
CPC ..... *H01R 11/28* (2013.01); *H01R 43/048* (2013.01); *H01R 43/26* (2013.01); *H01R 4/185* (2013.01); *H01R 11/09* (2013.01)

(58) Field of Classification Search
USPC ..... 439/287, 842, 843, 851, 877, 878, 883
See application file for complete search history.

(56) References Cited

U.S. PATENT DOCUMENTS

| | | | | |
|---|---|---|---|---|
| 4,815,200 | A * | 3/1989 | Ito | H01R 43/055 29/857 |
| 6,786,751 | B2 * | 9/2004 | Maeda | H01R 11/12 439/287 |
| 7,115,004 | B2 * | 10/2006 | Takayama | H01R 4/185 439/850 |
| 7,125,295 | B2 * | 10/2006 | Zhao | H01R 11/12 439/287 |
| 7,252,559 | B1 * | 8/2007 | Morello | H01R 4/185 439/843 |
| 7,252,564 | B1 * | 8/2007 | Morello | H01R 4/185 439/843 |
| 7,316,581 | B2 * | 1/2008 | Kumakura | H01R 4/182 439/422 |
| 7,422,480 | B1 * | 9/2008 | Musick | H01R 9/0518 439/585 |
| 7,494,388 | B2 * | 2/2009 | Kakuta | H01R 4/185 439/877 |
| 7,556,541 | B2 * | 7/2009 | Tyler | H01R 13/03 439/843 |
| 7,867,027 | B2 * | 1/2011 | Sakaguchi | H01R 4/184 439/585 |
| 8,105,121 | B2 * | 1/2012 | Miyamoto | H01R 4/646 439/883 |
| 8,328,589 | B2 * | 12/2012 | Hasebe | H01R 4/184 439/877 |
| 9,065,196 | B2 * | 6/2015 | Ohnuma | H01R 4/184 |
| 2006/0079138 | A1 | 4/2006 | Zhao et al. | |
| 2014/0154915 | A1 | 6/2014 | Ohnuma et al. | |
| 2015/0079825 | A1 | 3/2015 | Miyamoto et al. | |

FOREIGN PATENT DOCUMENTS

| | | |
|---|---|---|
| CN | 104170168 A | 11/2014 |
| JP | 2012-190749 A | 10/2012 |

* cited by examiner

CONNECTION METHOD FOR TERMINAL FITTING AND CONNECTION STRUCTURE OF TERMINAL FITTING

CROSS REFERENCE TO RELATED APPLICATIONS

This application claims priority from Japanese Patent Application No. 2015-233575 filed on Nov. 30, 2015, the entire contents of which are incorporated herein by reference.

BACKGROUND OF THE INVENTION

Field of the Invention

The present invention relates to a connection method for a terminal fitting and a connection structure of a terminal fitting.

Description of Related Art

There has been known a connection structure in which connection plates of a plurality of terminal fittings, to which grounding electric wires have been connected, are put on top of one another, a common bolt is inserted into mounting holes provided in the connection plates to thereby bolt and fasten the connection plates to a grounding surface (such as a predetermined place of a vehicle body), so that the grounding electric wires can be conductively connected to the grounding surface in a lump through the terminal fittings put on top of one another (for example, see Patent Literature 1: JP-A-2012-190749).

[Patent Literature 1] JP-A-2012-190749

According to a related art, in a structure in which terminal fittings put on top of one another are fastened by a bolt, the terminal fittings connected to grounding electric wires respectively are put on top of one another and fastened by the bolt. Therefore, the weight increases as the number of grounding electric wires increases. In addition, the thickness of the terminal fittings put on top of one another increases as the number of grounding electric wires increases. Thus, a large space for receiving the terminal fittings has to be secured above the grounding surface. In addition, much working time is required for fastening work while adjusting the nut length or the bolt length in accordance with the terminal fittings to be put on top of one another.

In addition, in order to conductively connect a plurality of grounding electric wires in a lump, it can be also considered to use a joint connector in which connection terminals connected to the grounding electric wires are inserted into a housing accommodating joint terminals to thereby conductively connect the grounding electric wires in a lump through the joint terminals while holding the connection terminals inside the housing. However, in the case of the joint connector, a holding mechanism (such as a lock lance) for holding the connection terminals inside the housing has to be provided. It is therefore difficult to miniaturize the housing. In addition, since the housing provided with the holding mechanism is required, the cost increases inevitably.

In addition, due to fastening by a bolt, reliability in connection may deteriorate after the connection because the bolt is loosened. In this case, when the connection terminals are crimped and fastened to the terminal fittings, a firm connection structure can be obtained. However, when the connection terminals and the terminal fittings are crimped by a crimping machine, there is a fear that their postures cannot be stabilized relatively to each other but a variation may occur in crimping strength.

SUMMARY

One or more embodiments provide a connection method for a terminal fitting capable of conductively connecting a plurality of electric wires in a lump with high reliability in connection while suppressing weight and saving space.

In an aspect (1), one or more embodiments provide a connection method for a terminal fitting, in which the terminal fitting includes a terminal body and a plurality of terminal connection portions extending from the terminal body, and a pair of fastening caulking pieces of each of connection terminals connected to end portions of electric wires are caulked and connected to a pair of fastened caulking pieces formed in a corresponding one of the terminal connection portions. The connection method is manufactured by:

folding open end portions of the fastened caulking pieces inward respectively to form folded portions and a space between the folded portions so that open end portions of the pair of fastening caulking portions enter the space; and crushing the pair of the fastening caulking pieces to caulk the pair of the fastened caulking pieces so that the open end portions of the pair of the fastening caulking pieces enter the space.

In an aspect (2), the connection method for the terminal fitting according to the aspect (1), may be further manufactured by:

forming a retention space in each of the connection terminals by the fastening caulking pieces so that the fastened caulking pieces are inserted into the retention space; and inserting one of the terminal connection portions into the retention space so that the open end portions of the pair of the fastened caulking pieces face to the same side as the open end portions of the pair of the fastening caulking pieces to thereby make the connection terminal retain the terminal connection portion.

In an aspect (3), the connection method for the terminal fitting according to the aspect (2), the fastening caulking pieces may include rotation regulation faces that abut against the fastened caulking pieces inserted into the retention space to thereby regulate rotation of the terminal connection portion around an axis extending in an insertion direction of the terminal connection portion.

According to the aspect (1), when the pair of the fastening caulking pieces are caulked to catch the pair of the fastened caulking pieces from outside, the open end portions of the pair of the fastening caulking pieces enter a space provided between folded parts formed at the upper ends of the pair of the fastened caulking pieces respectively, so that the fastening caulking pieces can caulk the fastened caulking pieces and the folded parts so as to catch the fastened caulking pieces and the folded parts from outside. Thus, the fastened caulking pieces including the folded parts are rounded inside the fastening caulking pieces and received therein tightly, so that the fastening connection portion can be filled with the fastened caulking pieces. In this manner, the fastening connection portion is fastened to the terminal connection portion firmly with high contact pressure, while the terminal fitting and the connection terminal can be conductively connected surely. Thus, electric resistance in the connection place can be stabilized to establish a good electric connection.

According to the aspect (2), the open end portions of the pair of the fastened caulking pieces are retained in the retention space so as to face on the same side as the open end portions of the pair of the fastening caulking pieces, and the fastening caulking pieces then caulk the fastened caulking pieces to catch the outsides thereof.

Thus, fastening work can be performed in the state where the posture of the terminal connection portion has been stabilized relatively to the connection terminal, so that workability in fastening the connection terminal to the terminal connection portion of the terminal fitting can be improved, while a variation in crimping strength can be suppressed to obtain high reliability in connection.

In addition, when the retention space is formed in the connection terminal in advance, the width size can be suppressed in comparison with a case where fastening caulking pieces are formed into a U-shape widened upward. Thus, components including a crimper can be miniaturized to save the working space during fastening by a crimping machine.

According to the aspect (3), the terminal connection portion of the terminal fitting abuts against the rotation regulation faces of the fastening caulking pieces so that the terminal connection portion can be kept in a predetermined posture with respect to the connection terminal.

Thus, without using any jig or the like for regulating rotation of the terminal connection portion, a good balance can be kept in the biting amounts of the fastening caulking pieces into the terminal connection portion, so that a variation in crimping strength can be suppressed to obtain high reliability in connection.

According to one or more embodiments, it is possible to provide a connection method for a terminal fitting capable of conductively connecting a plurality of electric wires in a lump with high reliability in connection while suppressing weight and saving space.

The invention has been described briefly above. The further details of the invention will be made clearer through with reference to the accompanying drawings.

BRIEF DESCRIPTION OF THE DRAWINGS

FIG. 6A is a sectional view taken on line B-B in FIG. 5. FIG. 6B is a sectional view taken on line C-C in FIG. 5. FIG. 6C is a sectional view taken on line D-D in FIG. 5.

FIG. 8A is a sectional view taken on line A-A in FIG. 1B, showing a state where the fastening caulking pieces have not been fastened yet. FIG. 8B is a sectional view taken on line A-A in FIG. 1B, showing a state where the fastening caulking pieces are being fastened. FIG. 8C is a sectional view taken on line A-A in FIG. 1B, showing a state where the fastening caulking pieces have been fastened.

DETAILED DESCRIPTION

An embodiment of the invention will be described below with reference to the drawings.

A connection method for a terminal fitting according to the embodiment of the invention will be described.

Figure 1A:
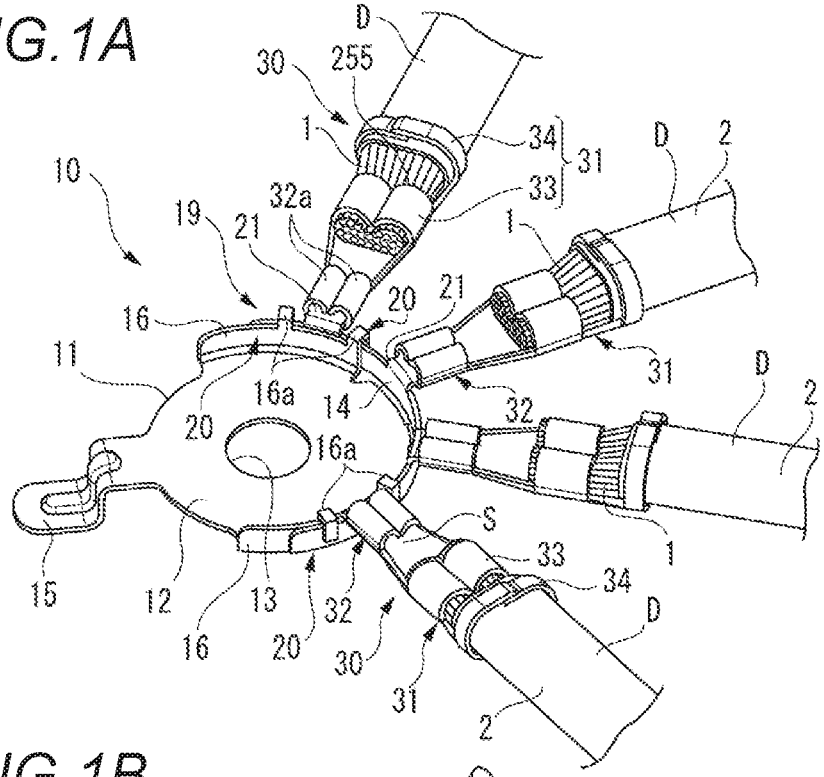
FIG. 1A is a perspective view of the terminal fitting to which grounding electric wires have been connected.
Figure 1B:
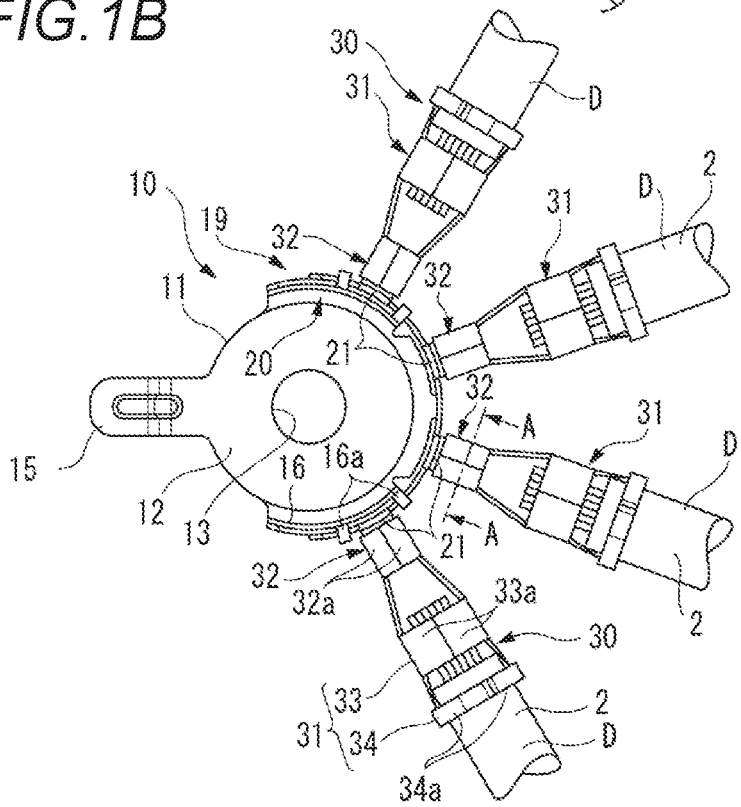
FIG. 1B is a plan view of the terminal fitting to which the grounding electric wires have been connected.

FIGS. 1A and 1B are views for explaining a connection structure of a terminal fitting according to the embodiment. FIG. 1A is a perspective view of a terminal fitting 10 to which grounding electric wires D have been connected, and FIG. 1B is a plan view of the terminal fitting 10 to which the grounding electric wires D have been connected.

As shown in FIGS. 1A and 1B, terminal connection portions 21 of the terminal fitting 10 and connection terminals 30 are connected in the connection structure of the terminal fitting according to the embodiment. The terminal fitting 10 is conductively connected to a grounding surface of a body or the like of a vehicle. The connection terminals 30 connected to the terminal fitting 10 are provided in end portions of the grounding electric wires (electric wires) D of on-vehicle circuits (accessories). Each grounding electric wire D has a conductor portion 1, and a jacket 2 covering the conductor portion 1. In the end portion where the grounding electric wire D is connected to the connection terminal 30, the conductor portion 1 is exposed from the jacket 2. In the grounding electric wire D, the conductor portion 1 is conductively connected to the connection terminal 30. In this manner, the grounding electric wires D of the on-vehicle circuits are conductively connected to the grounding surface of the body or the like of the vehicle through the terminal fitting 10. For example, 8 sq. mm grounding electric wires D are connected to the connection terminals 30.

Figure 2:
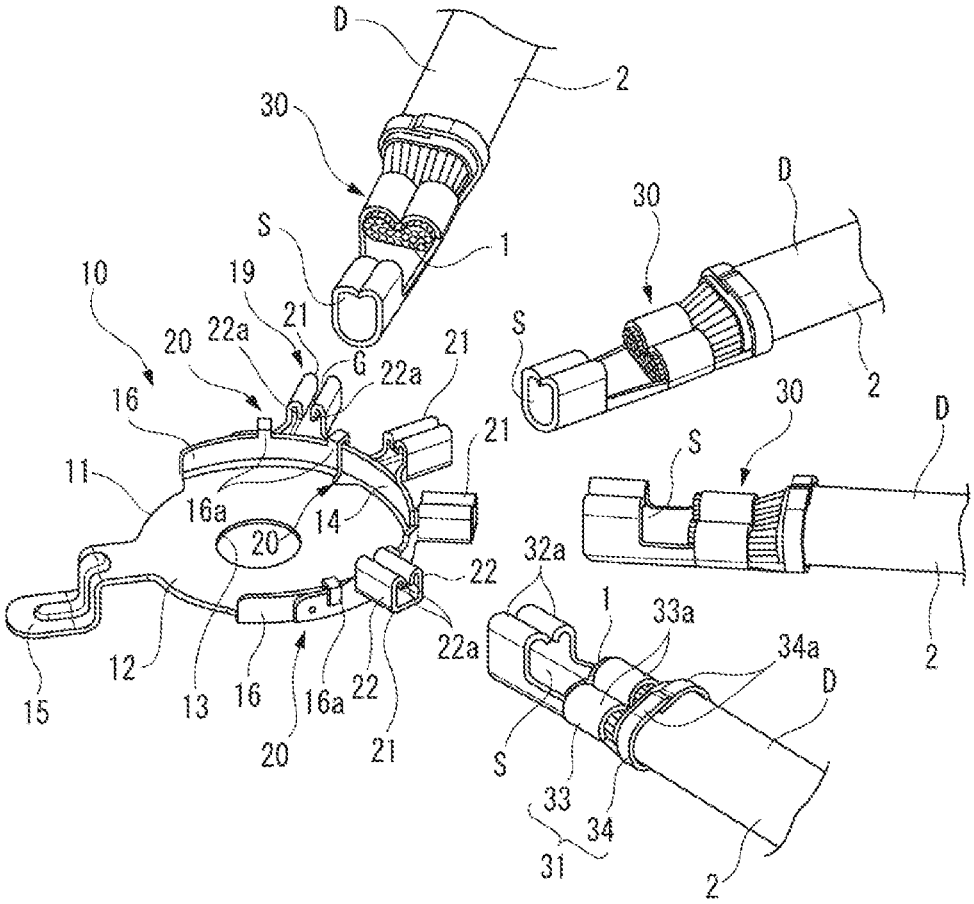
FIG. 2 is a view of the terminal fitting and connection terminals, for explaining the connection structure of the terminal fitting according to the embodiment.
Figure 3:
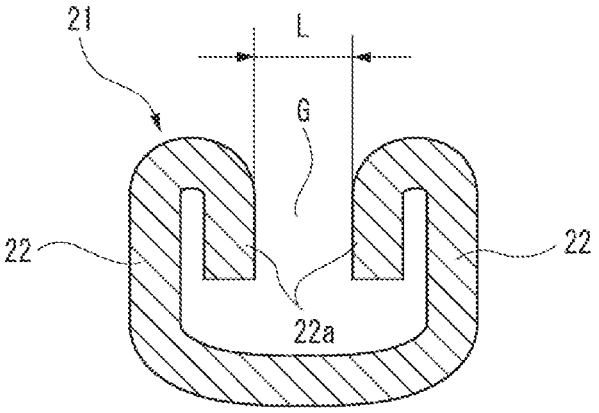
FIG. 3 is a cross sectional view of a terminal connection portion of the terminal fitting according to the embodiment.

FIG. 2 is a view of the terminal fitting 10 and the connection terminals 30, for explaining the connection structure of the terminal fitting according to the embodiment. FIG. 3 is a sectional view of a terminal connection portion 21 of the terminal fitting 10.

As shown in FIG. 2, the terminal fitting 10 has a terminal body 11, and an electric wire connection portion body 19 including a plurality of terminal connection portions 21. The terminal fitting 10 is a press-formed article formed out of a conductive metal plate. The terminal body 11 includes a fixed plate portion 12 having a circular shape in planar view. In the fixed plate portion 12, a circular mounting hole 13 is formed at the center thereof. The terminal body 11 is fixed to the grounding surface of the body or the like of the vehicle by a bolt (not shown) inserted into the mounting hole 13 of the fixed plate portion 12. Incidentally, the mounting hole 13 may be provided eccentrically rather than at the center of the fixed plate portion 12.

A rotation stopper piece 15 is formed in a part of the fixed plate portion 12. The rotation stopper piece 15 is a bent portion to be engaged with a step or a hole portion around the grounding surface to which the terminal body 11 is fastened by a bolt. When the rotation stopper piece 15 is engaged with the step or the hole portion around the grounding surface, the rotation stopper piece 15 regulates rotation of the terminal fitting 10 relative to the grounding surface.

Two support wall portions 16 each having an arc shape in planar view are formed at the circumferential edge of the fixed plate portion 12. With respect to the fixed plate portion 12, the support wall portions 16 are provided erectly on the side of the upper surface which is a one-side surface. In addition, in the electric wire connection portion body 19, a connection plate portion 14 having an arc shape in planar view is formed in an approximately half circumferential part of the circumferential edge of the fixed plate portion 12. With respect to the fixed plate portion 12, the connection plate portion 14 is provided erectly on the side of the upper surface which is a one-side surface. The connection plate portion 14 is disposed along the outer circumferential surfaces of the support wall portions 16.

A plurality of lock pieces 16*a* are formed at the upper edge of each support wall portion 16. The lock pieces 16*a* are folded back toward the outer surface of the connection plate portion 14 so that the opposite ends of the connection plate portion 14 can be locked by the lock pieces 16*a*. Thus, the connection plate portion 14 is supported by the support wall portions 16.

In this manner, in the terminal fitting 10, the parts where the connection plate portion 14 is locked by the lock pieces 16*a* of the support wall portions 16 serve as coupling portions 20. That is, the terminal fitting 10 includes a plurality of coupling portions 20 so that the terminal body 11 and the electric wire connection portion body 19 can be coupled with each other by the coupling portions 20.

Each terminal connection portion 21 is formed integrally with the connection plate portion 14 of the terminal body 11. A plurality of terminal connection portions 21 are provided in upper edge parts of the connection plate portion 14. Specifically, four terminal connection portions 21 are formed in the connection plate portion 14. The terminal connection portions 21 are extended, within one and the same plane, from the circumferential edge of the fixed plate portion 12 so as to project radially.

As shown in FIG. 3, each terminal connection portion 21 has engagement walls 22 in its opposite side portions. The engagement walls 22 serve as fastened caulking pieces that project on the side of the upper surface which is a one-side surface. Thus, each terminal connection portion 21 is formed into a U-shape in front view. In addition, each engagement wall 22 has a folded portion 22*a* in its upper end portion. The folded portion 22*a* is bent inward and folded like an arc. A space G is provided between the folded portions 22*a* of the engagement walls 22. The space G has a distance L to which the open end portions of a pair of fastening caulking pieces 32*a* of the connection terminal 30 can be inserted. The connection terminal 30 will be described later. In addition, each terminal connection portion 21 is bent so that its bottom portion can swell outward.

Figure 4:
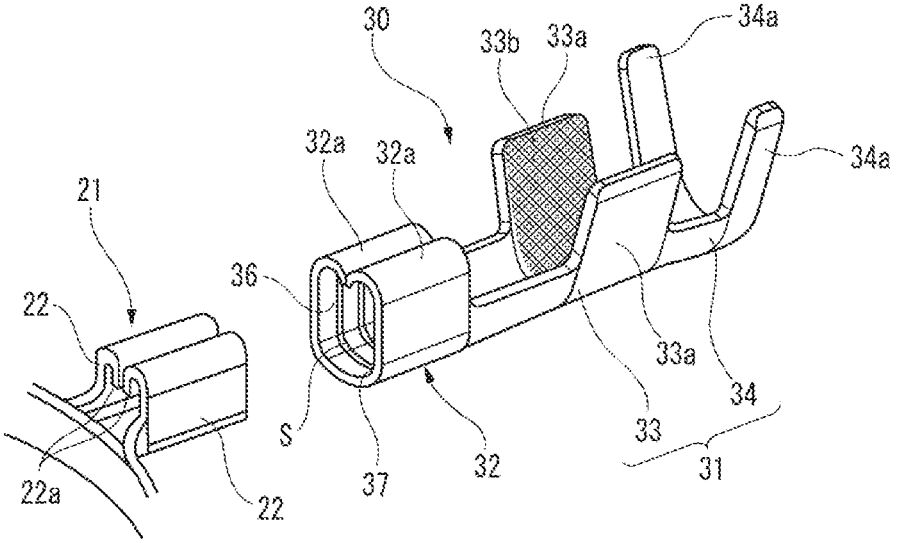
FIG. 4 is a perspective view of the terminal connection portion and the connection terminal.
Figure 5:
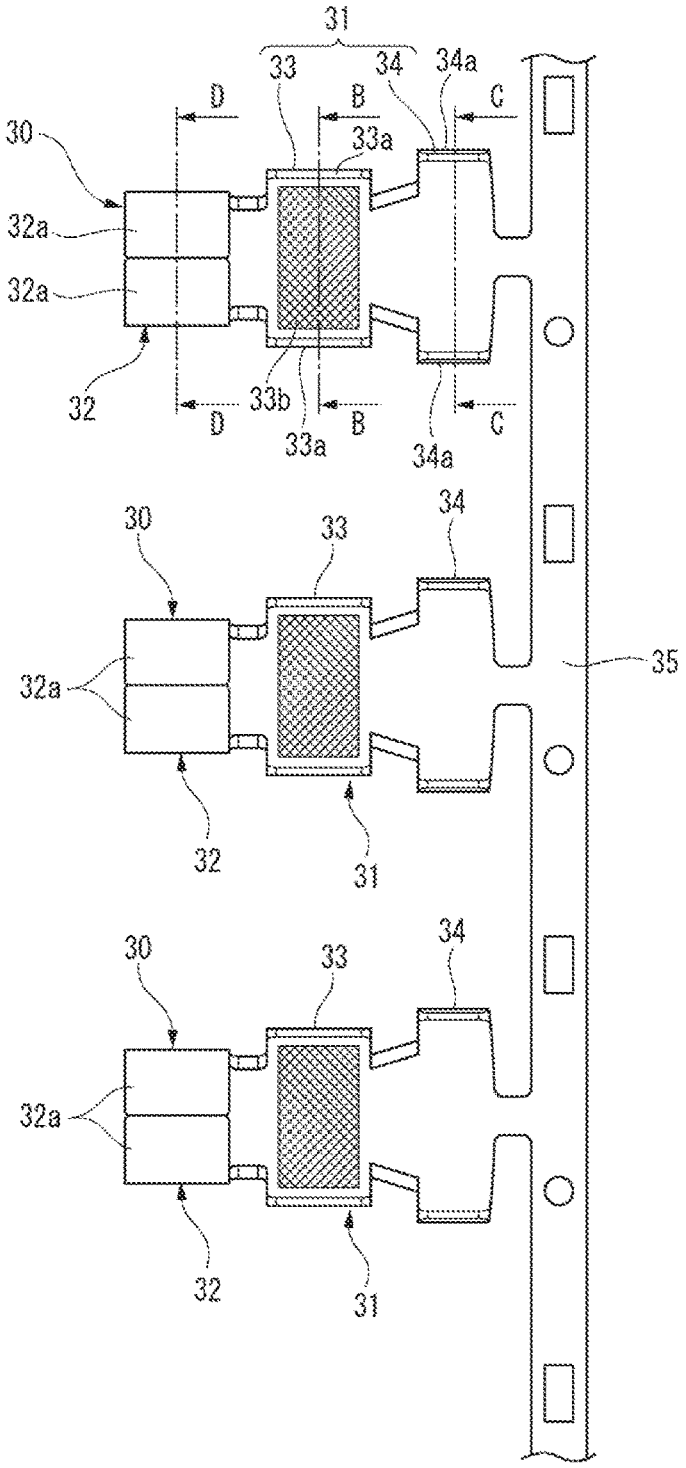
FIG. 5 is a plan view of connection terminals coupled with a carrier.
Figure 6A:
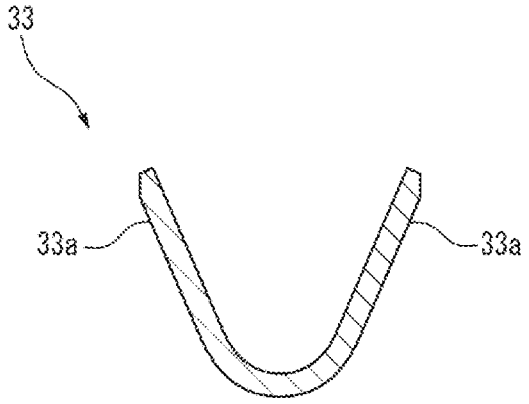
FIGS. 6A to 6C are views for explaining a connection terminal.
Figure 6B:
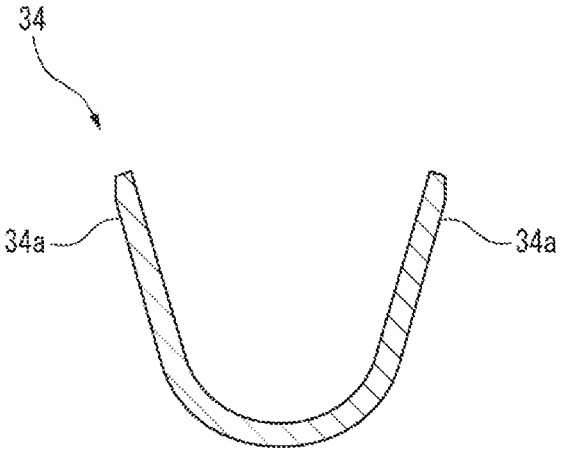
Figure 6C:
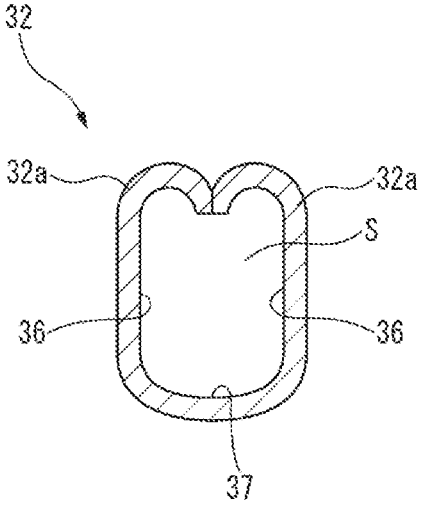

FIG. 4 is a perspective view of a terminal connection portion 21 and a connection terminal 30. FIG. 5 is a plan view of connection terminals 30 coupled with a carrier. FIGS. 6A to 6C are views for explaining a connection terminal 30. FIG. 6A is a sectional view taken on line B-B in FIG. 5. FIG. 6B is a sectional view taken on line C-C in FIG. 5. FIG. 6C is a sectional view taken on line D-D in FIG. 5.

As shown in FIG. 4, each connection terminal 30 has an electric wire connection portion 31 and a fastening connection portion 32. A grounding electric wire D is connected to the electric wire connection portion 31. The connection terminal 30 provided in the grounding electric wire D is a press-formed article formed out of a conductive metal plate. The fastening connection portion 32 is caulked and fastened to one of the terminal connection portions 21 of the terminal fitting 10.

As shown in FIG. 5, the connection terminals 30 are supplied in the state where the connection terminals 30 have been coupled with a belt-like carrier 35 on their electric wire connection portion 31 side. To use each connection terminal 30, the connection terminal 30 is separated from the carrier 35. Each electric wire connection portion 31 has a conductor caulking portion 33 and a coating caulking portion 34.

As shown in FIG. 4 and FIG. 6A, the conductor caulking portion 33 is formed into a U-shape including a pair of conductor caulking pieces 33*a*. When the conductor caulking pieces 33*a* are caulked, the conductor portion 1 of the grounding electric wire D is caulked and fixed to the conductor caulking portion 33. Thus, the conductor portion 1 of the grounding electric wire D is conductively connected to the connection terminal 30. In addition, a rough surface portion (serration) 33*b* that has been roughened by machining is provided in the inner surface of the conductor caulking portion 33. Incidentally, the rough surface portion 33*b* is not limited to the illustrated shape. Thus, the conductor portion 1 of the grounding electric wire D caulked to the conductor caulking portion 33 can be conductively connected to the connection terminal 30 surely.

As shown in FIG. 4 and FIG. 6B, the coating caulking portion 34 is formed into a U-shape including a pair of coating caulking pieces 34*a*. When the coating caulking pieces 34*a* are caulked, the jacket 2 of the grounding electric wire D is caulked and fixed to the coating caulking portion 34.

In order to connect the grounding electric wire D to the connection terminal 30, the jacket 2 is removed to expose the conductor portion 1 in an end portion of the grounding electric wire D. Then, the end portion of the grounding electric wire D is disposed on the electric wire connection portion 31 of the connection terminal 30, and the conductor caulking portion 33 is caulked while the coating caulking portion 34 is caulked. After that, the connection terminal 30 is separated from the carrier 35. Thus, the grounding electric wire D is conductively connected to the connection terminal 30.

As shown in FIG. 4 and FIG. 6C, the fastening connection portion 32 of the connection terminal 30 has a pair of fastening caulking pieces 32*a*. The fastening caulking pieces 32*a* are provided erectly upward from a bottom portion of the fastening connection portion 32 respectively. In addition, the upper end portions of the fastening caulking pieces 32*a* are bent and folded inward in an arc shape.

Thus, a retention space S surrounded by the fastening caulking pieces 32*a* is formed in the fastening connection portion 32 of the connection terminal 30. The opposite side faces of the retention space S are formed into substantially vertical faces due to the fastening caulking pieces 32*a* provided erectly upward. The opposite side faces serve as rotation regulation faces 36. In addition, a bottom face 37 forming the retention space S is bent to swell downward slightly.

The retention space S of the fastening connection portion 32 is formed to be a little larger than the outer shape of the terminal connection portion 21 in front view. Thus, the terminal connection portion 21 can be inserted into the retention space S (see FIG. 8A). The terminal connection portion 21 inserted into the retention space S abuts against the rotation regulation faces 36 constituted by the opposite side faces forming the retention space S. In this manner, the terminal connection portion 21 can be regulated from rotating around an axis extending in the direction in which the terminal connection portion 21 has been inserted into the retention space S.

Next, description will be made about the connection method for the terminal fitting in which the connection terminal 30 is caulked and fastened to the terminal connection portion 21 of the terminal fitting 10.

Figure 7:
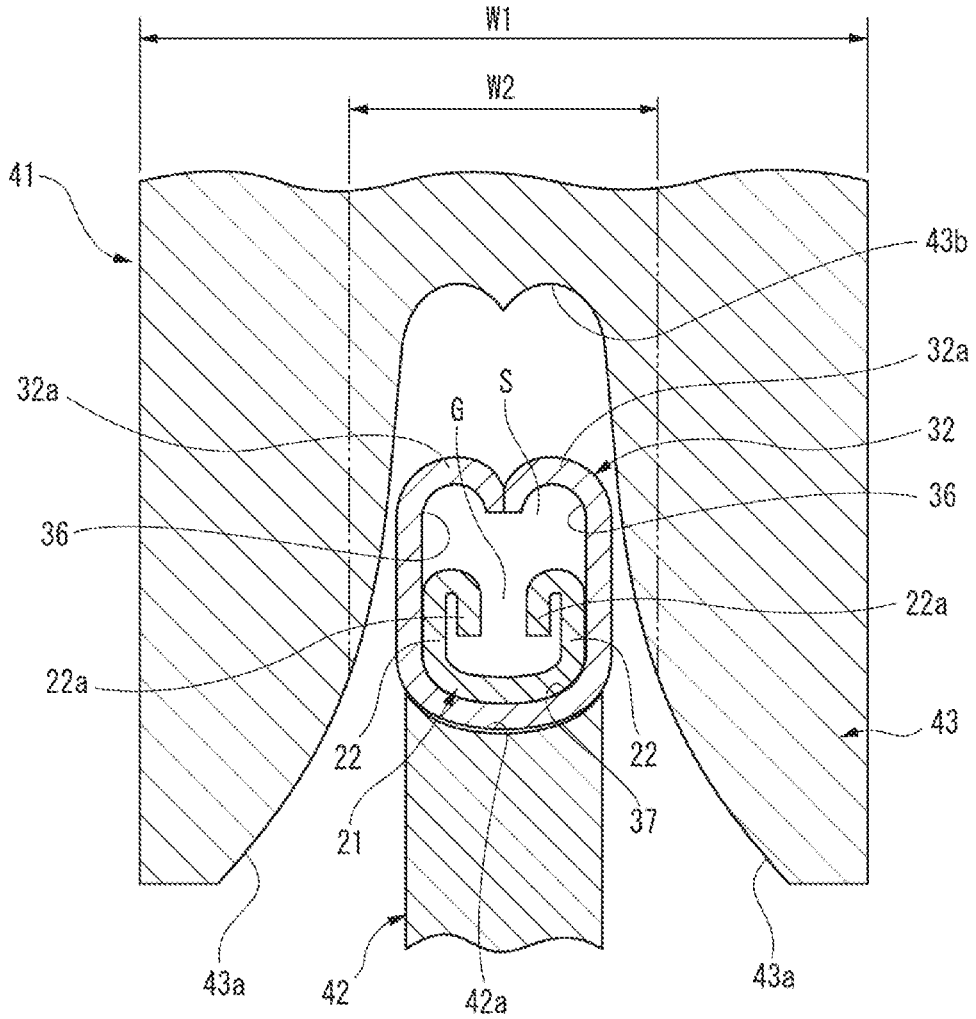
FIG. 7 is a schematic sectional view of a crimping machine in which a connection terminal and a terminal connection portion have been set.
Figure 8A:
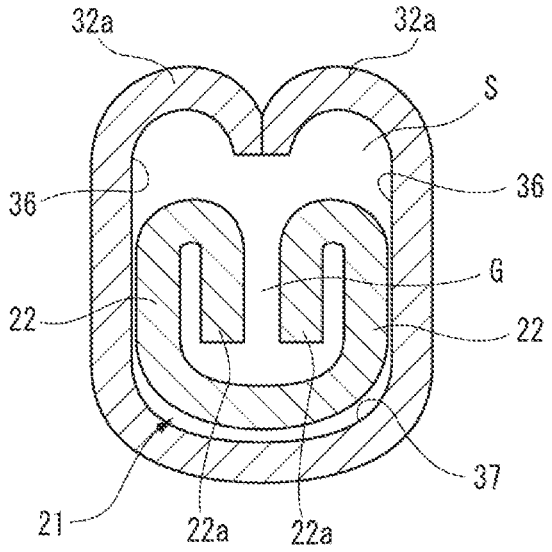
FIGS. 8A to 8C are views each showing a fastening state of fastening caulking pieces of a fastening connection portion to a terminal connection portion of the terminal fitting.
Figure 8B:
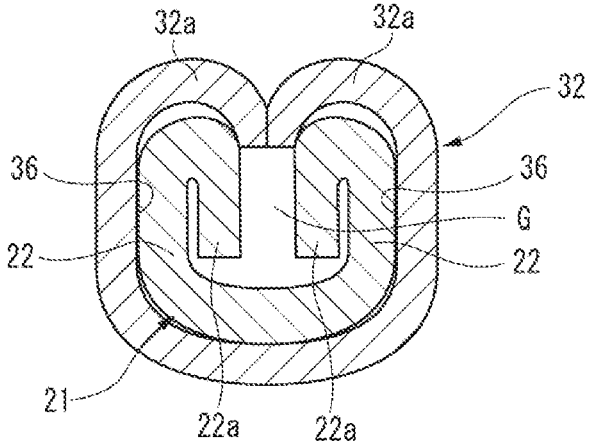
Figure 8C:
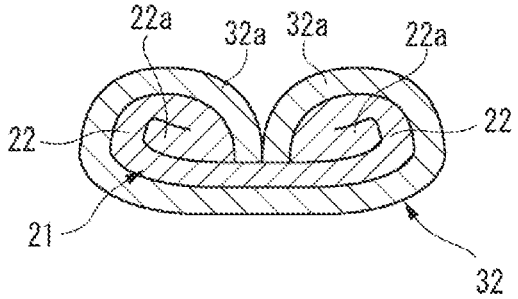

FIG. 7 is a schematic sectional view of a crimping machine 41 in which the connection terminal 30 and the terminal connection portion 21 have been set. FIGS. 8A to 8C are views each showing a fastening state of the fastening caulking pieces 32*a* of the fastening connection portion 32 to the terminal connection portion 21 of the terminal fitting 10. FIG. 8A is a sectional view taken on line A-A in FIG. 1B, showing a state where the fastening caulking pieces 32*a* have not been fastened yet. FIG. 8B is a sectional view taken on line A-A in FIG. 1B, showing a state where the fastening caulking pieces 32*a* are being fastened. FIG. 8C is a sectional view taken on line A-A in FIG. 1B, showing a state where the fastening caulking pieces 32*a* have been fastened.

As shown in FIG. 7, the crimping machine 41 for crimping the connection terminal 30 on the terminal connection portion 21 to thereby caulk and fasten the connection terminal 30 thereto includes an anvil 42, and a crimper 43 that can approach and leave the anvil 42. The top surface of the anvil 42 serves as a mounting face 42*a*. The connection terminal 30 is mounted on the mounting face 42*a*. The mounting face 42*a* is formed into a shape that is recessed slightly downward like an arc. Thus, the connection terminal 30 mounted on the mounting face 42*a* is disposed on the anvil 42. The crimper 43 is formed into a concave shape including a guide face 43*a* spreading gently toward the anvil 42. The crimper 43 has pressing faces 43*b* in an upper portion of its concave part. The pressing faces 43*b* press the fastening caulking pieces 32*a* while guiding the fastening caulking pieces 32*a* toward the inside respectively.

(Temporarily Fixing Step)

As shown in FIG. 8A, first, the connection terminal 30 and the terminal connection portion 21 are temporarily fixed to each other. Specifically, the terminal connection portion 21 is inserted into the retention space S of the connection terminal 30. On this occasion, the terminal connection portion 21 is inserted into the retention space S so that the open end portions of the pair of engagement walls 22 can face on the same side as the open end portions of the pair of the fastening caulking pieces 32*a*. When the terminal connection portion 21 is thus inserted into the retention space S, the opposite side portions of the terminal connection portion 21 abut against the rotation regulation faces 36 constituted by the opposite side faces of the retention space S. Thus, the terminal connection portion 21 is retained by the fastening connection portion 32 of the connection terminal 30 in the state where the terminal connection portion 21 is regulated from rotating around the axis extending in the insertion direction. Thus, the terminal connection portion 21 is kept in a predetermined posture with respect to the connection terminal 30.

In addition, the bottom face 37 of the retention space S is bent downward in a concave shape. Accordingly, the terminal connection portion 21 inserted into the retention space S has a stable posture on the bottom face 37. Particularly, the bottom portion of the terminal connection portion 21 is bent to swell outward so that the terminal connection portion 21 can be fitted into the bottom face 37 of the retention space S to be thereby stabilized.

(Mounting Step)

As shown in FIG. 7, the connection terminal 30 temporarily fixing the terminal connection portion 21 is mounted on the mounting face 42*a* of the anvil 42 of the crimping machine 41. In this state, the terminal connection portion 21 is still inserted into the retention space S. Therefore, the terminal connection portion 21 is regulated from rotating around the axis extending in the insertion direction, so that the terminal connection portion 21 can be kept in the predetermined posture with respect to the connection terminal 30.

(Fastening Step)

The crimping machine 41 is actuated to start crimping and move down the crimper 43 of the crimping machine 41. Thus, the fastening connection portion 32 is guided into the concave part by the guide faces 43*a* of the crimper 43. Still on this occasion, the terminal connection portion 21 is kept in the predetermined posture inside the retention space S with respect to the connection terminal 30. After that, the pressing faces 43*b* of the crimper 43 abut against the upper portions of the fastening caulking pieces 32*a* of the fastening connection portion 32. As a result, the fastening caulking pieces 32*a* are crushed to start caulking.

Then, as shown in FIG. 8B, the fastening caulking pieces 32*a* catch the opposite side portions of the terminal connection portion 21. After that, the open end portions of the fastening caulking pieces 32*a* enter the space G provided between the folded portions 22*a* formed at the upper ends of the pair of engagement walls 22 respectively, so that the fastening caulking pieces 32*a* can be caulked to catch the engagement walls 22 of the terminal connection portion 21 and the folded portions 22*a* at the upper ends thereof from outside. That is, the pair of the fastening caulking pieces 32*a* are crushed so that the open end portions of the fastening caulking pieces 32*a* can enter the space G. Thus, the pair of engagement walls 22 and the folded portions 22*a* can be caulked.

Thus, as shown in FIG. 8CS, the pair of engagement walls 22 including the folded portions 22*a* are rounded inside the fastening caulking pieces 32*a* and received therein tightly so that the fastening connection portion 32 can be filled with the terminal connection portion 21. Accordingly, the fastening connection portion 32 is fastened to the terminal connection portion 21 firmly with high contact pressure, while the terminal fitting 10 and the connection terminal 30 are conductively connected surely.

When the terminal connection portions 21 of the terminal fitting 10 and the connection terminals 30 are fastened and connected in the aforementioned steps, the grounding electric wires D are conductively connected to the terminal fitting 10 in a lump. When the terminal fitting 10 is fixed to the grounding surface of the vehicle by a bolt, the grounding electric wires D are grounded.

As has been described above, according to the connection method for the terminal fitting according to the embodiment, the terminal connection portion 21 is inserted into the retention space S surrounded by the fastening caulking pieces 32*a* of the connection terminal 30 so that the terminal connection portion 21 can be retained by the connection terminal 30. Thus, the fastening caulking pieces 32*a* can be caulked and fastened in the state where the terminal connection terminal 21 has been retained by the connection terminal 30. As a result, the terminal connection portion 21 can be kept in a stable posture when it is being caulked and fastened. Thus, a variation in crimping strength can be suppressed to obtain high reliability in connection.

In addition, according to the connection method for the terminal fitting according to the embodiment, the terminal connection portion 21 is inserted into and retained by the retention space S formed in advance in the connection terminal 30, and the fastening caulking pieces 32*a* are crushed and fastened to caulk and catch the outer sides of the opposite side portions of the terminal connection portion 21 inside the retention space S. Thus, the fastening work can be performed in the state where the posture of the terminal connection portion 21 has been stabilized with respect to the connection terminal 30. In this manner, the workability can be improved, and a variation in crimping strength can be suppressed to obtain high reliability in connection. In addition, due to the retention space S formed in advance in the connection terminal 30, the width size can be suppressed in comparison with a case where the fastening caulking pieces 32*a* are formed into a U-shape widened upward. Thus, components including the crimper 43 can be miniaturized to save the working space during fastening by the crimping machine 41. For example, as shown in FIG. 7, in comparison with the case where fastening caulking pieces formed into a U-shape widened upward are caulked, the guide faces 43*a* can be made so small that the width size of the crimper 43 can be set at W2, which is much smaller than W1.

In addition, the terminal connection portion 21 inserted into the retention space S is retained by the connection terminal 30 in the state where the terminal connection portion 21 is regulated from rotating around the axis extending in the insertion direction by the rotation regulation faces 36 constituted by the opposite side faces of the retention space S. Thus, the terminal connection portion 21 can be kept in a more stable posture with respect to the connection terminal 30, so that the accuracy of caulking and fastening can be enhanced.

In addition, the terminal connection portion 21 inserted into the retention space S is retained in a stable state due to the bottom face 37 of the retention space S bent downward. Thus, the terminal connection portion 21 can be kept in a more stable posture with respect to the connection terminal 30, so that the accuracy of fastening can be enhanced.

In addition, according to the embodiment, when a plurality of grounding electric wires D are connected to the terminal fitting 10, the grounding electric wires D can be conductively connected to the terminal fitting 10 in a lump. It is therefore unnecessary to stack terminal fittings 10. Accordingly, in comparison with a background-art structure in which terminal fittings connected to grounding electric wires respectively are stacked and fastened for conductive connection, increase in weight of the terminal fitting 10 can be suppressed even when the number of grounding electric wires D increases. In addition, since it is not necessary to stack terminal fittings 10, the thickness of the terminal fitting 10 does not increase even when the number of electric wires D to be conductively connected increases. Thus, space saving can be attained. In addition, since the connection terminals 30 are fastened to the terminal connection portions 21 of the terminal fitting 10, it is possible to dispense with a special holding mechanism for holding the connection terminals 30. Thus, reduction in size and cost can be attained in comparison with a joint connector in which a holding mechanism for holding terminals has to be provided in a housing.

In addition, due to the structure in which separate connection terminals 30 are fastened and connected to the terminal fitting 10, the connection terminals 30 to which grounding electric wires D different in size have been connected can be fastened and conductively connected to the terminal connection portions 21. That is, grounding electric wires D having various sizes can be dealt with without changing the connection forms between the terminal connection portions 21 of the terminal fitting 10 and the fastening connection portions 32 of the connection terminals 30. In addition, when terminal fittings 10 differing in number of terminal connection portions 21 are prepared, it is possible to easily deal with increase or decrease in number of grounding electric wires D to be conductively connected.

Here, for example, a plurality of grounding electric wires D can be conductively connected in a lump in a terminal fitting in which a plurality of connection portions to which the grounding electric wires D can be connected are formed integrally. However, such a terminal fitting has to be prepared in accordance with the number of grounding electric wires D to be connected. In addition, a terminal fitting having connection portions corresponding to the grounding electric wires D has to be prepared in accordance with a change in size of the grounding electric wires D.

On the other hand, according to the connection method for the terminal fitting according to the embodiment, a change in number or size of grounding electric wires D to be conductively connected can be dealt with by a required minimum variation of terminal fittings 10.

In addition, due to the structure in which connection terminals 30 are caulked and fastened to a plurality of terminal connection portions 21 of the terminal fitting 10, the connection terminals 30 can be fastened to the terminal connection portions 21 in accordance with necessity. Thus, the number of grounding electric wires D to be conductively connected in a lump can be increased or decreased easily within the range of the number of terminal connection portions 21.

In addition, the engagement walls 22 that can be engaged with the fastening caulking pieces 32*a* are formed in the opposite side portions of the terminal connection portion 21. Accordingly, when the fastening caulking pieces 32*a* of the connection terminal 30 are caulked to the terminal connection portion 21, the fastening caulking pieces 32*a* are engaged with the engagement walls 22 of the terminal connection portion 21. Thus, the fastening caulking pieces 32*a* are surely crimped on the terminal connection portion 21 so that the connection strength of the connection terminal 30 to the terminal connection portion 21 can be further enhanced. It is therefore possible to stabilize electric resistance at the connection place to thereby improve the electric connection.

Further, the pair of the fastening caulking pieces 32*a* enter the space G provided between the folded portions 22*a* formed respectively at the upper ends of the pair of engagement walls 22. When the fastening caulking pieces 32*a* are caulked to catch the engagement walls 22 and the folded portions 22*a* from outside, the engagement walls 22 including the folded portions 22*a* are rounded inside the fastening caulking pieces 32*a* and received therein tightly. Thus, the fastening connection portion 32 is filled with the terminal connection portion 21. In this manner, the fastening connection portion 32 is fastened to the terminal connection portion 21 firmly with high contact pressure, so that the reliability in connection of the connection terminal 30 to the terminal connection portion 21 is improved.

In addition, the terminal connection portions 21 according to the embodiment are extended radially within one and the same plane. Accordingly, it is possible to provide a large number of terminal connection portions 21 while suppressing the area occupied by the terminal fitting 10 as much as possible. Thus, a large number of grounding electric wires D can be connected in a lump.

In addition, in the connection structure of the terminal fitting according to the embodiment, the electric wire connection portion body 19 coupled with the terminal body 11 through the coupling portion 20 is separated for the sake of disassembly. In this manner, the grounding electric wires D can be separated from the terminal body 11 in a lump. Thus, good recycling efficiency can be obtained.

In addition, the locking force with which the coupling portion 20 coupling the terminal body 11 with the electric wire connection portion body 19 is locked by the locking pieces 16*a* can be adjusted. For example, the locking force can be adjusted in accordance with the diameters of grounding electric wires D, the number of the grounding electric wires D to be connected, the wiring condition of the grounding electric wires D, etc. Thus, connection strength during wiring can be secured surely while good separation performance during disassembly can be also secured. Thus, durability and recycling efficiency can be made compatible. For example, the coupling strength between the terminal body 11 and the electric wire connection portion body 19 can be adjusted within a range from strength required as connection strength to strength allowing separation (for example, from 100 N to 500 N).

Incidentally, the terminal connection portion 21 in the aforementioned embodiment is formed into a U-shape in section due to the engagement walls 22 provided in the opposite side portions thereof, and the folded portions 22*a* bent inward and folded like an arc are formed in the upper end portions of the engagement walls 22. However, the sectional shape of the terminal connection portion 21 is not limited to the aforementioned one.

Incidentally, in the aforementioned embodiment, grounding electric wires D of on-vehicle circuits (accessories) are connected to the terminal fitting 10 so that the grounding electric wires D can be grounded in a lump. However, electric wires to be connected to the terminal fitting 10 are not limited to the grounding ones.

In addition, the rotation stopper piece 15 is not provided in the terminal body 11 of the terminal fitting 10 but a step or a rotation stopper piece that can abut against the terminal fitting 10 to thereby serve as a rotation stopper when the terminal fitting 10 is attached to the grounding surface may be provided on the grounding surface side.

Incidentally, the invention is not limited to the aforementioned embodiment, but deformations, improvements, etc. can be made suitably. In addition, materials, shapes, dimensions, numbers, arrangement places, etc. of respective constituent elements in the aforementioned embodiment are not limited. Any materials, any shapes, any dimensions, any numbers, any arrangement places, etc. may be used as long as the invention can be attained.

Here, the features of the aforementioned embodiment of the connection structure and the connection method for the terminal fitting according to the invention will be summarized and listed briefly in the following paragraphs [1] to [4].

[1] A connection method for a terminal fitting, in which the terminal fitting (10) includes a terminal body (11) and a plurality of terminal connection portions (21) extending from the terminal body, and a pair of fastening caulking pieces (32*a*) of each of connection terminals (30) connected to end portions of electric wires (grounding electric wires D) are caulked and connected to a pair of fastened caulking pieces (engagement walls 22) formed in a corresponding one of the terminal connection portions, the connection method comprising:

folding open end portions of the fastened caulking pieces inward respectively to form folded portions (22*a*) and a space (G) between the folded portions so that open end portions of the pair of fastening caulking portions enter the space; and crushing the pair of the fastening caulking pieces to caulk the pair of the fastened caulking pieces so that the open end portions of the pair of the fastening caulking pieces enter the space.

[2] The connection method for the terminal fitting according to [1], further comprising:

forming a retention space (S) in each of the connection terminals by the fastening caulking pieces so that the fastened caulking pieces are inserted into the retention space (S); and inserting one of the terminal connection portions into the retention space so that the open end portions of the pair of the fastened caulking pieces face to the same side as the open end portions of the pair of the fastening caulking pieces to thereby make the connection terminal retain the terminal connection portion.

[3] The connection method for the terminal fitting according to [2], wherein the fastening caulking pieces include rotation regulation faces (36) that abut against the fastened caulking pieces inserted into the retention space to thereby regulate rotation of the terminal connection portion around an axis extending in an insertion direction of the terminal connection portion.

[4] A connection structure for a terminal fitting comprising:

the terminal fitting (10) including a terminal body (11) and a plurality of terminal connection portions (21) extending from the terminal body; and connection terminals (30) connected to end portions of electric wires (grounding electric wires D), wherein each of the connection terminals include a pair of fastening caulking pieces (32*a*), wherein open end portions of a pair of fastened caulking pieces (engagement walls 22) formed in each of the terminal connection portions are folded inward respectively to form folded portions (22*a*) and a space (G) between the folded portions so that open end portions of the pair of fastening caulking portions enter the space, wherein the pair of the fastening caulking pieces are caulked with the pair of the fastened caulking pieces and the open end portions of the pair of the fastening caulking pieces enter the space, and wherein the terminal fitting is connected to the electric wires through the connection terminals.

DESCRIPTION OF REFERENCE NUMERALS AND SIGNS

10 terminal fitting, 11 terminal body, 21 terminal connection portion, 22 engagement wall (fastened caulking piece), 22*a* folded portion, 30 connection terminal, 32*a* fastening caulking piece, D grounding electric wire (electric wire), S retention space

What is claimed is:

1. A connection method for a terminal fitting and a plurality of electric wire assemblies, in which the terminal fitting includes a terminal body and a plurality of terminal connection portions extending from the terminal body, and the electric wire assemblies include connection terminals connected to end portions of electric wires, the connection method comprising:

providing each of the connection terminals with a pair of fastening caulking pieces;

providing each of the terminal connection portions with a pair of fastened caulking pieces;

folding free ends of open end portions of the fastened caulking pieces inward respectively to form folded portions and a space that extends between the folded portions such that the free ends are space away from each other;

deforming the pair of the fastening caulking pieces so that free ends of the pair of the fastening caulking pieces enter the space;

crushing the pair of fastening caulking pieces and the pair of fastened caulking pieces after the free ends of the fastening caulking pieces enter the space; and maintaining separation between each of the terminal connection portions and the electric wire upon connecting the terminal fitting and the electric wires through the connection terminals.

2. The connection method for the terminal fitting according to claim 1, further comprising:

forming, before the deforming the pair fastening caulking pieces, and before the crushing the pair of fastening caulking pieces and the pair of fastened caulking pieces, a retention space in each of the connection terminals by the fastening caulking pieces that is configured to receive the fastened caulking pieces; and inserting, before the deforming the pair fastening caulking pieces, and before the crushing the pair of fastening caulking pieces and the pair of fastened caulking pieces, one of the terminal connection portions into the retention space so that the open end portions of the pair of the fastened caulking pieces face to the same side as the open end portions of the pair of the fastening caulking pieces to thereby make the connection terminal retain the terminal connection portion.

3. The connection method for the terminal fitting according to claim 2, further comprising:

providing the fastening caulking pieces with rotation regulation faces; and crushing the pair of fastening caulking pieces and the pair of fastened caulking pieces includes regulating rotation of the terminal connection portion around an axis extending in an insertion direction of the terminal connection portion by abutting the fastening caulking pieces against the fastened caulking pieces inserted into the retention space.

4. A connection structure for a terminal fitting comprising:

the terminal fitting including a terminal body and a plurality of terminal connection portions extending from the terminal body; and connection terminals connected to end portions of electric wires, wherein each of the connection terminals includes a pair of fastening caulking pieces, wherein each of the terminal connection portions includes a pair of fastened caulking pieces, the pair of fastened caulking pieces include respective end portions that are folded inward to form folded portions that include free ends that are spaced away from each other by a space that extends between the folded portions, and the space is configured to receive respective free ends of end portions of the pair of fastening caulking portions as the pair of fastening caulking pieces are caulked with the pair of the fastened caulking pieces, wherein the pair of the fastening caulking pieces are caulked with the pair of the fastened caulking pieces after the free ends of the pair of the fastening caulking pieces enter the space, and wherein each of the terminal connection portions is spaced away from the electric wire and the terminal fitting is connected to the electric wires through the connection terminals.

5. The connection structure for a terminal fitting according to claim 4, wherein each of the connection terminals includes an electric wire connection portion that is spaced away from the pair of fastening caulking pieces.

6. The connection structure for a terminal fitting according to claim 4, wherein each of the connection terminals includes an electric wire connection portion, and each of the connection terminals terminates at one end at the electric wire connection portion and terminates at an opposite end at the pair of fastening caulking pieces.

7. The connection structure for a terminal fitting according to claim 4, wherein each of the connection terminals includes a pair of conductor caulking pieces caulked and connected to a conductor of the electric wire, and a pair of coating caulking pieces caulked and connected to a jacket of the electric wire, and the pair of fastening caulking pieces are space away from each of the pair of conductor caulking pieces and the pair of coating caulking pieces.

* * * * *